US007367640B2

(12) United States Patent
Bergstedt et al.

(10) Patent No.: US 7,367,640 B2
(45) Date of Patent: May 6, 2008

(54) METHODS AND APPARATUSES FOR CONTROL OF A SIGNAL IN A PRINTING APPARATUS

(75) Inventors: Steven W. Bergstedt, Winchester, KY (US); Jason K. Young, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 336 days.

(21) Appl. No.: 11/241,088

(22) Filed: Sep. 30, 2005

(65) Prior Publication Data

US 2007/0076032 A1 Apr. 5, 2007

(51) Int. Cl.
*B41J 29/38* (2006.01)

(52) U.S. Cl. ..... 347/10; 347/11

(58) Field of Classification Search ..... 347/10, 347/11, 12, 56–59
See application file for complete search history.

(56) References Cited

U.S. PATENT DOCUMENTS 5,673,071 A * 9/1997 Fuse ..... 347/35
5,726,690 A 3/1998 Bohorquez et al.
5,742,307 A 4/1998 Watrobski et al.
5,963,233 A 10/1999 Shirota et al.
6,296,350 B1 10/2001 Cornell et al.
6,302,514 B1 10/2001 Eade et al.
6,386,674 B1 * 5/2002 Corrigan et al. ..... 347/19
6,491,377 B1 12/2002 Cleland et al.
6,676,246 B1 1/2004 Anderson et al.

* cited by examiner

*Primary Examiner*—Lamson Nguyen
(74) *Attorney, Agent, or Firm*—Dinsmore & Shohl, LLP

(57) ABSTRACT

A printing apparatus and related methods are provided that precisely control the transition of an electrical signal that causes a printing substance to be deposited. In particular, in some embodiments, a circuit is configured to control the application of a firing pulse to a printing element, and the printing element is configured to control the application of a printing substance. The circuit in this embodiment is configured to condition or control the transition of the firing pulse from the first state to the second state such that current through the printing element dissipates to zero over a period of time that is neither too fast nor too slow.

5 Claims, 9 Drawing Sheets

METHODS AND APPARATUSES FOR CONTROL OF A SIGNAL IN A PRINTING APPARATUS

TECHNICAL FIELD

The present application relates generally to printing methods and apparatuses and more specifically to methods and apparatuses for control of a signal controlling a printing element.

BACKGROUND

Many printing apparatuses are controlled by a pulse signal or firing signal which causes a printing substance, such as ink for example, to be applied to a print medium such as paper. For instance, an ink jet printing apparatus may include a printhead having printing elements that are controlled by a signal. In particular, the printhead can comprise an ink reservoir and an ink ejection chip with nozzles and corresponding printing elements or ink ejection actuators, such as heaters. In such printing devices, signals are supplied that cause the heaters to heat the ink held in a chamber at the nozzles which in turn causes the ink to be ejected from the nozzles onto the print medium at selected ink dot locations within an image area. A carrier moves the printhead relative to the medium, while the ink dots are jetted onto selected pixel locations.

Users of printing apparatuses continue to demand higher quality images and text which requires higher resolution, or, in other words, that more dots be printed per unit area. Users also continue to demand higher print speeds, such that pages can be printed faster. One way to achieve higher resolution and higher speeds is to include smaller components, such as smaller ink actuators and nozzles which create the dots, and to operate these components at faster speeds. However, as ink actuators become smaller, they require less energy in order to nucleate the ink and cause it to be ejected onto the print media. Therefore, these components are more sensitive to energy, and if excess energy begins to build up in the system, the components may cause ejection of ink at undesired times. Accordingly, excess energy needs to be controlled to permit correct printing, particularly for high speed and high resolution printing where actuators are more sensitive.

Excess energy can build up over time due to various factors. For instance, excess energy may build up due to the transitions of current flow between on and off states under control of the signals that control the actuators. In particular, in a thermal ink jet printing apparatus, the actuators comprise heating elements that can be controlled by a firing pulse that allows current to be turned on to create the heating effect (and cause the ejection of the printing substance) and then turned off to stop the heating effect (and stop any additional ejection). The dissipating current as the heater is turned off can cause build up of energy, energy that is not needed but is a result of the transitioning process. Therefore, turning off the current flow to the heater in a rapid manner is desired. On the other hand, a heating element cannot be turned off too fast because rapid changes in that current and/or in the firing pulse that causes that current can cause excess voltages to appear in the system, due to inductances of the circuitry and components. These excess voltages or back EMF can cause damage to circuit components and to heaters if they exceed a certain level.

Therefore, it is desired to precisely control the speed the speed of these transitioning signals such that they are 1) not too fast so as to cause back EMF damage, 2) fast enough so that high resolution and speed can be achieved, and 3) not too slow such that excess energy builds up and causes untimely firing of the heater, decreased component life, and other problems.

The temperature of a printing apparatus can vary widely during operation. The firing of heaters or other actuators can cause build up of heat which can affect the performance of the circuit components. This can cause variances in the amount of control over the speed at which signals are turned on and off. As mentioned above, controlling these transition speeds at precise levels is important for proper operation and to prevent damage. Accordingly, it is also desired to provide methods and systems that accurately control the timing of the printer signals across a broad range of operating temperatures. It is further desired to control such signals utilizing circuit components which are not difficult to implement.

SUMMARY

According to one embodiment, a circuit is provided for controlling current to an actuator element configured to deposit ink in a printing apparatus. The circuit comprises at least one circuit component configured to cause current through an actuator element to dissipate in a controlled manner by controlling at least one edge of a firing signal pulse. (The edge of the firing pulse comprises a transition from a first state to a second state.)

According to another embodiment, a circuit is provided for controlling magnitude of current flowing to an actuator element configured to deposit ink in a printing apparatus. The circuit comprises at least one switching device configured to selectively allow and cutoff the flow of current to an actuator based upon a firing signal turning on and off. The actuator is configured to deposit a printing substance in a printing apparatus. The circuit further comprises at least one circuit component having standard sizing relative to other components on the printing apparatus, wherein the component is configured to control the firing signal provided to the switching device in order to cause flow of current to the actuator to dissipate slowly enough such that damaging levels of voltages are not induced in the circuit. The component is further configured to control the firing signal to cause flow of current to the actuator to dissipate quickly enough such that the actuator current reaches substantially zero in under about 1 microsecond.

In accordance with another embodiment, a printing apparatus is provided that comprises a main body configured to hold a printing substance, a heater configured to heat printing substance for transfer to a print media, and a conductor configured to transmit a firing pulse to actuate a heater. The apparatus further comprises a circuit configured to control the firing pulse on the conductor such that the falling edge of the firing pulse reaches approximately zero in a period of time. The period of time is greater than the amount of time that would produce a back EMF that would damage the printing apparatus and wherein the period of time is less than about 600 nanoseconds.

According to another embodiment, a printing apparatus is provided comprising a circuit configured to control the application of a firing pulse to a printing element which controls the application of a printing substance. The firing pulse transitions from a first state which turns the printing element on to a second state which turns the printing element off. The circuit is configured to control the transition of the firing pulse from the first state to the second state such that current through the printing element dissipates to zero over a period of time. The circuit is further configured such that the period of time changes with respect to temperature by less than or equal to about 25 percent over a range of temperatures between about 27 degrees Celsius and about 80 degrees Celsius. The circuit resides on a substrate and the temperatures correspond to temperatures of the substrate adjacent the circuit.

BRIEF DESCRIPTION OF THE DRAWINGS

While the specification concludes with claims particularly pointing out and distinctly claiming the present invention, it is believed the same will be better understood from the following description of examples taken in conjunction with the accompanying drawings wherein like numerals indicate corresponding elements and wherein:

DETAILED DESCRIPTION OF ILLUSTRATIVE EMBODIMENTS

Figure 1:
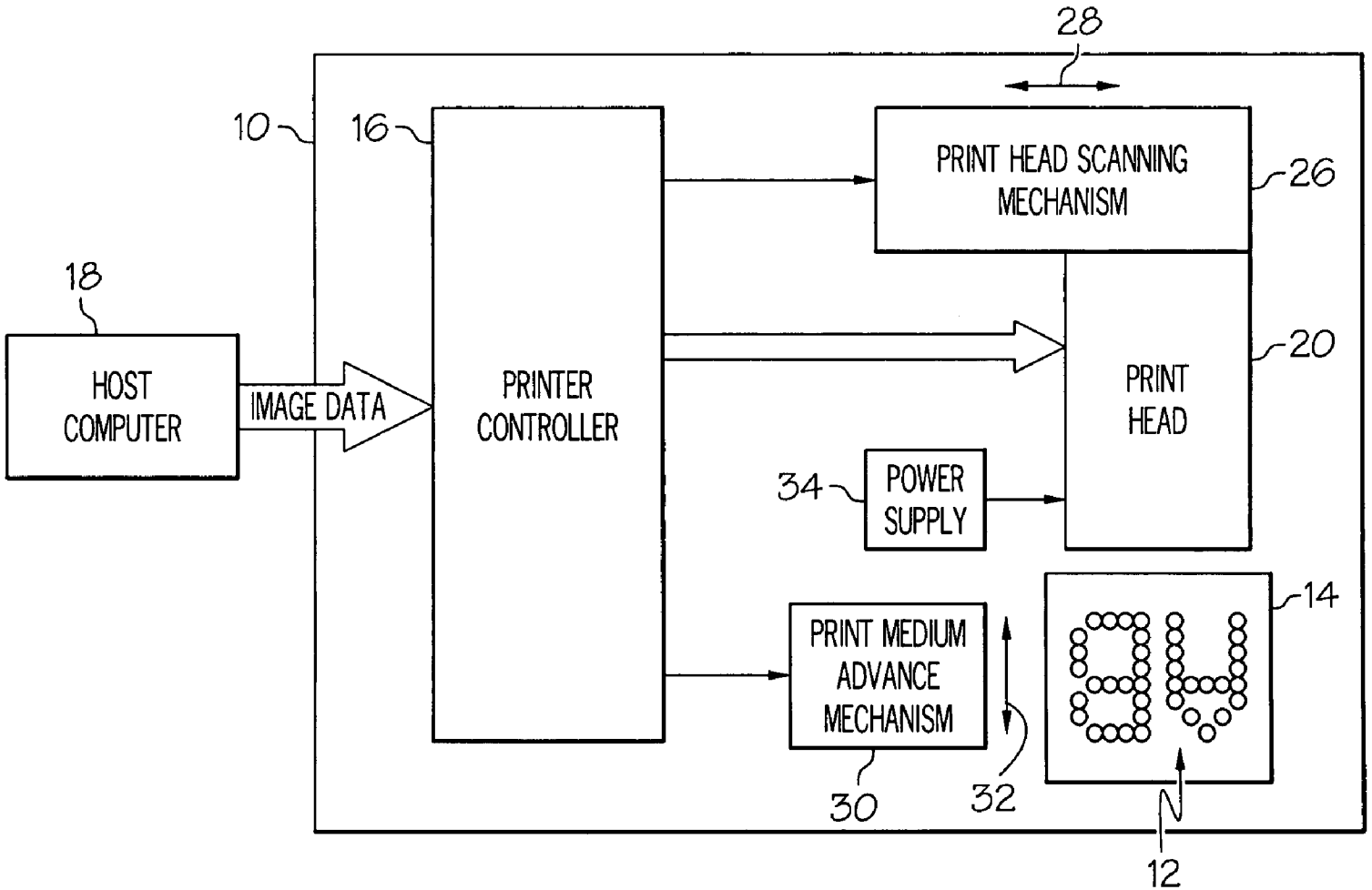
FIG. 1 is a block diagram illustrating an embodiment of a printing apparatus in the form of an ink jet printer having a control circuit made and operating according to principles of the present invention.

According to some embodiments, circuits, methods, and devices for printing apparatuses are provided which provide precise control of signals relating to the firing of printing actuators, such that they are not too fast nor too slow. In particular, in one embodiment, the circuit is configured to control the application of a firing pulse to a printing element, and the printing element is configured to control the application of a printing substance. The circuit in this embodiment is configured to condition or control the transition of the firing pulse from a first state to the second state such that current through the printing element dissipates to zero over a period of time that is fast enough for printing at high resolution and speed and avoiding excess energy buildup, yet slow enough that damaging levels of back EMF are not produced. The circuit of this embodiment exhibits low temperature variability and can be implemented without need for components of unusual sizing.

The embodiments described herein can be incorporated into a print head for use in an ink jet printer. In this regard, and with reference to FIG. 1, there is shown an ink jet printer 10 for printing an image 12 on a print medium 14, with which embodiments of the present invention can be utilized and/or incorporated. The printer 10 can include a printer controller 16, such as a digital microprocessor, that receives image data from a host computer 18. Generally, the image data generated by the host computer 18 describes the image 12 in a bit-map format.

Figure 2:
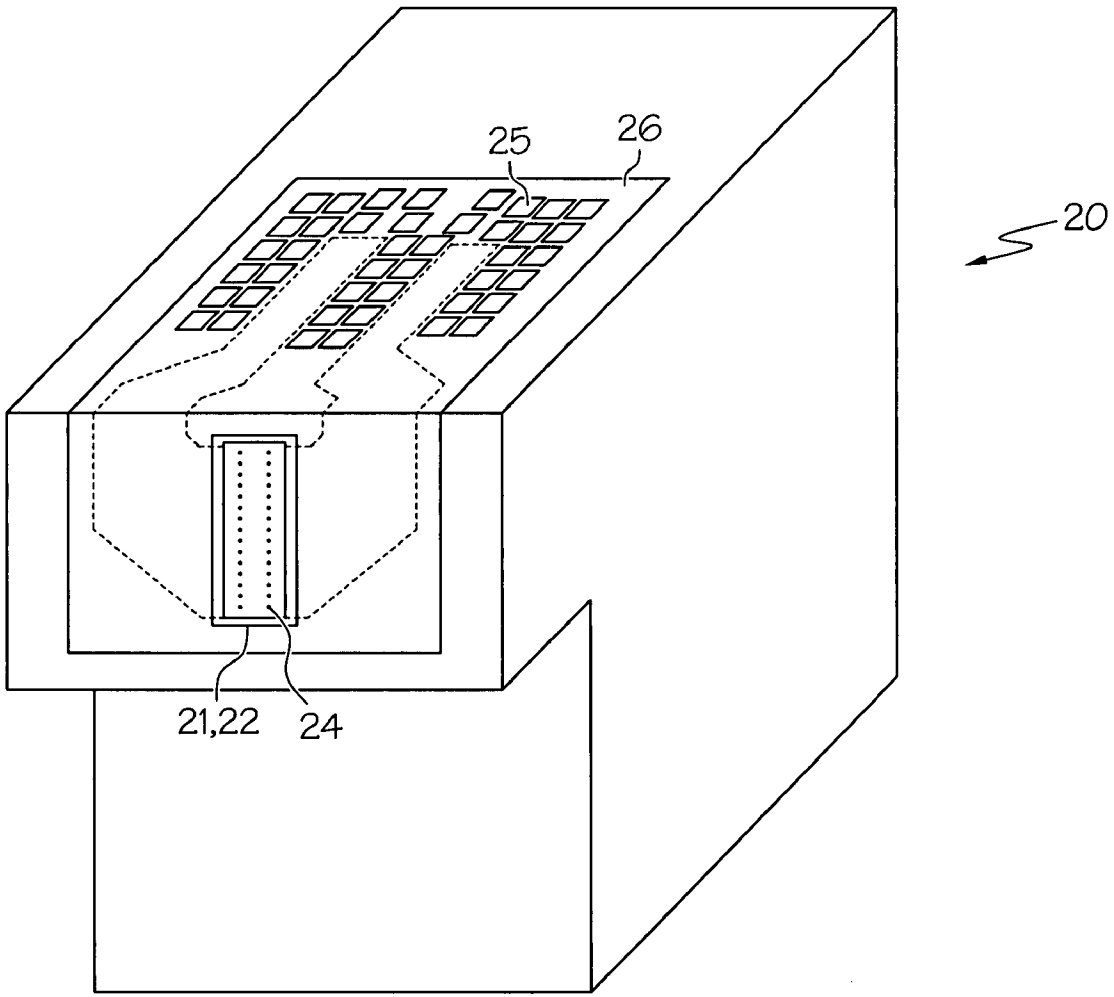
FIG. 2 is a perspective view of an embodiment of a printing apparatus in the form of a printhead having a control circuit made and operating according to principles of the present invention.

As shown in the illustrative examples FIGS. 1 and 2, the printer 10 can include a print head 20 that holds ink and that receives print signals from the printer controller 16. On the print head 20 can be provided a thermal ink jet heater chip 21 covered by a nozzle plate 22 which includes one or more chambers or passageways within which ink is held. Within the nozzle plate 22 are nozzles 24 to allow ink to eject from the chambers or passageways. Based on the print signals from the printer controller 16, ink droplets are ejected from selected ones of the nozzles 24 to form dots on the print medium 14 corresponding to the image 12. As described in more detail hereinafter, in this embodiment, ink is selectively ejected from a selected nozzle 24 when a corresponding heating element on the heater chip 21 is activated by the print signals provided from the controller 16. These print signals can comprise addressing signals for addressing appropriate heaters at appropriate times. The signals can be delivered to the printhead 20 via an electrical connection, such as via a tab circuit 26 having contacts 25 for connection to pins on the printhead carrier and for delivery of the heater address signals. As used herein, the term "ink" will be understood to refer to both pigment and dye based printing inks.

Returning to FIG. 1, the printer 10 also can include a print head scanning mechanism 26 for scanning the print head 20 across the print medium 14 in a scanning direction as indicated by the arrow 28. The print head scanning mechanism 26 can consist of a carriage which slides horizontally on one or more rails, a belt attached to the carriage, and a motor that engages the belt to cause the carriage to move along the rails. The motor can be driven in response to the commands generated by the printer controller 16.

The printer 10 can also include a print medium advance mechanism 30. Based on print medium advance commands generated by the controller 16, the print medium advance mechanism 30 causes the print medium 14 to advance in a paper advance direction, as indicated by the arrow 32, between consecutive scans of the print head 20. Thus, the image 12 is formed on the print medium 14 by printing multiple adjacent swaths as the print medium 14 is advanced in the advance direction between swaths. In one embodiment, the print medium advance mechanism 30 is a stepper motor rotating a platen which is in contact with the print medium 14. As shown FIG. 1, the printer 10 also includes a power supply 34 for providing a supply voltage to the print head 20 scanning mechanism 26 and print medium advance mechanism 30.

Figure 3:
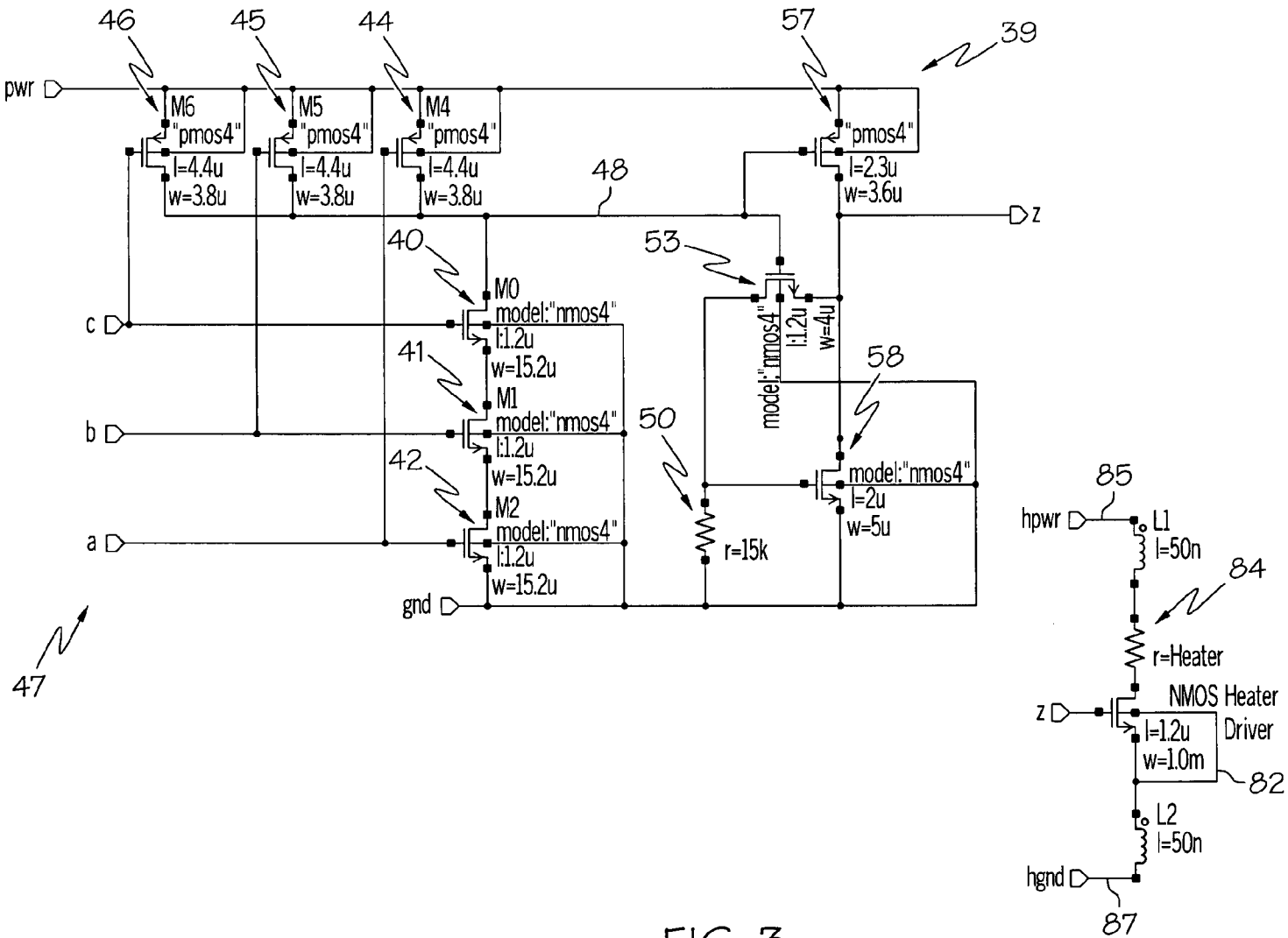
FIG. 3 is a circuit diagram illustrating an example embodiment of a pre-drive control circuit that controls the transitioning of a heater firing pulse, the circuit being made and operating according to principles of the present invention.

FIG. 3 is a circuit diagram illustrating an example embodiment of a pre-drive circuit 39 that controls the transitioning of a heater firing pulse, according to principles of the present invention. This circuit 39 can be provided on the chip 24 of the printhead 20 of FIG. 2 for example. The output of the circuit 39 is shown at contact Z in FIG. 3, and this output is provided to a heater driver switch 82. The driver switch of this example is an nMOS transistor having a relatively large gate width to account for the large current that it switches to the heater 84. When the driver 82 is closed, current is allowed to flow from supply line 85 through the heater 84 and to ground 87, and when the driver 82 is open the current is prevented from flowing. Control of the on and off states of the driver 82 is determined by the state of the signal provided on the input Z to the switch. When the driver 82 is closed and current flows through the heater 84, the heater 84 begins to provide heat, and this heat can be used to increase the temperature of the printing substance to cause it to be ejected to a print medium. The heater 84 can comprise an appropriately sized resistor, such as a 100 ohm resistor for example. A plurality of such heaters 84 can be provided to permit multiple firing of ink dots in a desired pattern on the print medium, such as discussed above. For example, one heater 84 can be provided for each nozzle 24 shown in FIG. 2. As an alternative to heaters, other actuators may be utilized.

As shown in the example of FIG. 3, control logic can also be provided, the output of which allows the firing signal to be provided at appropriate times. The firing signal is controlled or conditioned, and the conditioned firing signal is provided on the Z connector to subsequently control the firing of the switch 82 at appropriate times. In this example, the control logic is implemented as a NAND gate formed by a plurality of NMOS transistors 40, 41, and 42, the gates of which connect to address lines 47, labeled a, b, and c respectively. The address lines 47 provide address signals and a firing signal used to select the particular heater 84 and to command it to turn on for a given amount of time. This selection and timing is implemented by a NAND operation that is carried out by the NMOS transistors 40, 41, and 42, in combination with PMOS transistors 44, 45, and 46. In this example, each of the gates of the NMOS transistors 40-42 connect to a corresponding gate of one of the PMOS transistors 44-46, and each of the sources of the pMOS transistors connect to power. The NMOS transistors 42 and 41 connect drain to source, as do NMOS transistors 41 and 40, while the source of transistor 42 connects to ground. The drain of transistor 40 connects to the drains of the transistors 44, 45, and 46 to provide an output line 48 that controls the transistor 57 which controls the firing of the driver 82 and, therefore, the on/off cycling of current through the heater 84.

Accordingly, the address lines 47 are used to turn on and off the driver 82 at appropriate times via the logic device. The signals provided on these lines 47 can thus cause the desired firing pulse to be provided on connector Z at appropriate times corresponding to print data provided by the printer controller which has translated data received by a computer corresponding to an image to be printed. In particular, as mentioned above, typical printing operations require ink to be ejected from particular orifices or nozzles at particular points in time. To accomplish this, data signals, typically in the form of multiple sequences of voltage levels on multiple communication lines are transmitted in accordance with particular timing constraints. For example, in one embodiment, one signal may be used to transmit "address" data, which may correspond to a 32-bit binary numeral. Meanwhile, another signal may be used to transmit "primitive" data, which may also correspond to a 32-bit binary numeral. The circuit 39 on the ink ejection chip will then respond to this address and primitive data, amongst other data, to selectively eject ink from a specific location (e.g., from a specific nozzle in communication with a specific actuator, such as heater 84, corresponding to that address and primitive). Such data is typically clocked into the chip within a predefined range of time, and this data controls the signals supplied on conductors 47. Accordingly, the data provided on conductors 47 can control the output 48, which causes corresponding switching of transistors 53 and 57, to ultimately provide a signal on output Z. This output signal on conductor Z controls the firing of the driver 82, the resultant heating of the heater 84, and the corresponding ejection of ink at the desired location.

Embodiments herein can precisely control the transitioning of the resultant firing signal as provided on line Z and the current flow through the heater 84 during this switching. More specifically, in the example of FIG. 3, when a low signal (a logical 0) is provided at line 48 at the desired time as controlled by the address conductors 47, PMOS transistor 57 turns on while NMOS transistor 53 turns off. This causes transistor 57 to conduct such that the signal on output Z goes high, subsequently causing the NMOS heater driver 82 to switch on and current to flow through the heater 84 from line 85 to line 87. However, when a high signal (a logical 1) is provided at line 48 (at the desired time as controlled by the address conductors 47) PMOS transistor 57 turns off while NMOS transistor 53 turns on. This causes transistor 57 to open which then causes the NMOS heater driver 82 to switch off and current to stop to flow through the heater 84 from line 85 to line 87. However, as described above, it is desired to precisely control the dissipation of the transition energy which is capacitively stored in the NMOS heater driver 82 when it turns off and the transition energy which flows through the heater. In this example, the control of this dissipation is providing by transistor 58 in conjunction with resistor 50 which work to condition or control the transitioning of the firing pulse to its off state (i.e., its falling edge), so as to provide a conditioned firing pulse on line Z. Again, during this transition, the transistor 53 is on and conducting and the transition current on line Z sources through the resistor 50 to ground (gnd). This current dissipates at a rate of the output voltage on the Z connection (in volts) divided by the resistance of resistor 50 (e.g., 15K ohms). However, because the drain of transistor 58 is connected to the source of transistor 53 and to the output Z and because the gate of the transistor 58 connects to the source of transistor 53, the transistor 58 acts as a diode which draws a large initial current to ground initially but then begins to switch off such that the current exponentially decreases to virtually zero. However, the resistor 50 continues to draw the remaining current until all of the energy has been eliminated. This design allows for more precise control over the current using multiple standard components that can be implemented without need for special accommodations or unusually sized components. (Examples of gate dimensions that can be utilized are shown in FIG. 3. As shown in this figure and the other embodiments, standard resistor and transistor components can be utilized, and the transistors may be of sizes with small relative gate length to width, such as those having a gate length to width of less that 4.5:1.0, such as less than about 3.0:1.0 or less than about 2.5:1.0 for example.).

Figure 4:
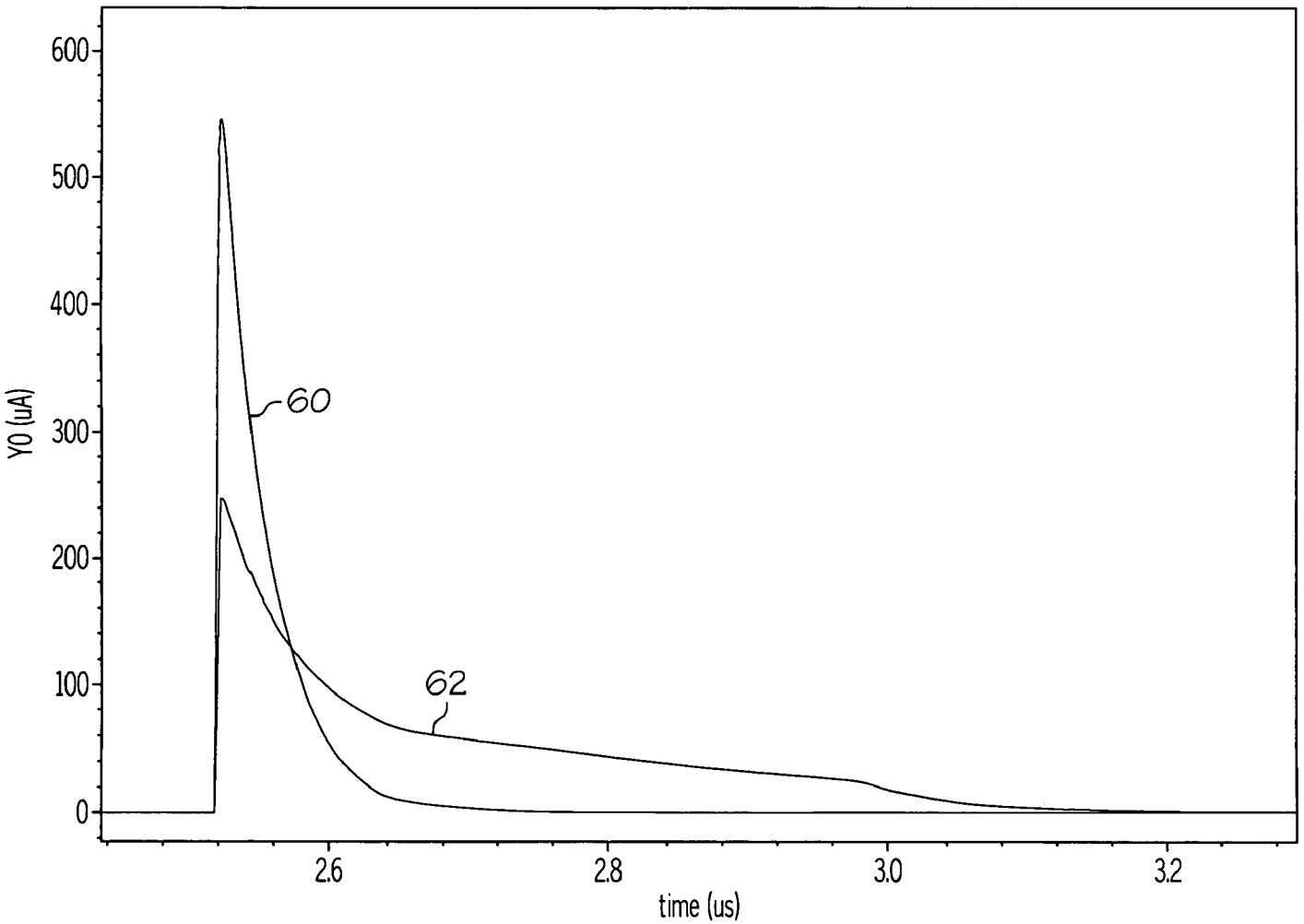
FIG. 4 is a graph that illustrates the dual current dissipation effect that can be provided by the dual dissipating components of FIG. 3 and according to additional inventive principles.

FIG. 4 is a graph that illustrates examples of the dual current dissipation effect that can be provided by the dual dissipating components of FIG. 3 and according to additional inventive principles. In this example, the transistor 58 providing the diode effect dissipates the current on line Z over time according to the graph 60 (which is an example of the current flowing through the transistor 58), while the resistor 50 dissipates the current on line Z over time according to the graph 62 (which is an example of the current flowing through resistor 50). These multiple components combine to produce a fast initial dissipating current that combines with a later more slowly dissipating current. It has been found that such a combination of effects can produce an ideal falling edge current that is neither too fast to cause back EMF nor too slow to maintain excess energy In particular, in this illustrative embodiment, the diode current 60 is above 500 microamps and quickly falls below 50 microamps in about 80 nanoseconds, while the resistor current 62 has a smaller maximum but draws its current for a longer time decreasing to zero at about 600 nanoseconds after the falling edge of the triggering logic signal (the firing signal). The two currents in graphs 60 and 62 combine to form a piece-wise linear (PWL) current that quickly discharges the signal provided on Z to the NMOS heater driver 82 to a point approximately where the driver begins to shut off and then slowly discharges the capacitive charge at the gate of the diver beyond this point. In this manner, the NMOS heater driver 82 is driven to its off state quickly but without inducing a large back EMF voltage. The NMOS devices 53 and 58 used as the switch and diode are small relative to other components in the circuit, as shown by the example dimensions shown in FIG. 3, and therefore can be easily manufactured in a standard predrive circuit area and layout.

Figure 5:
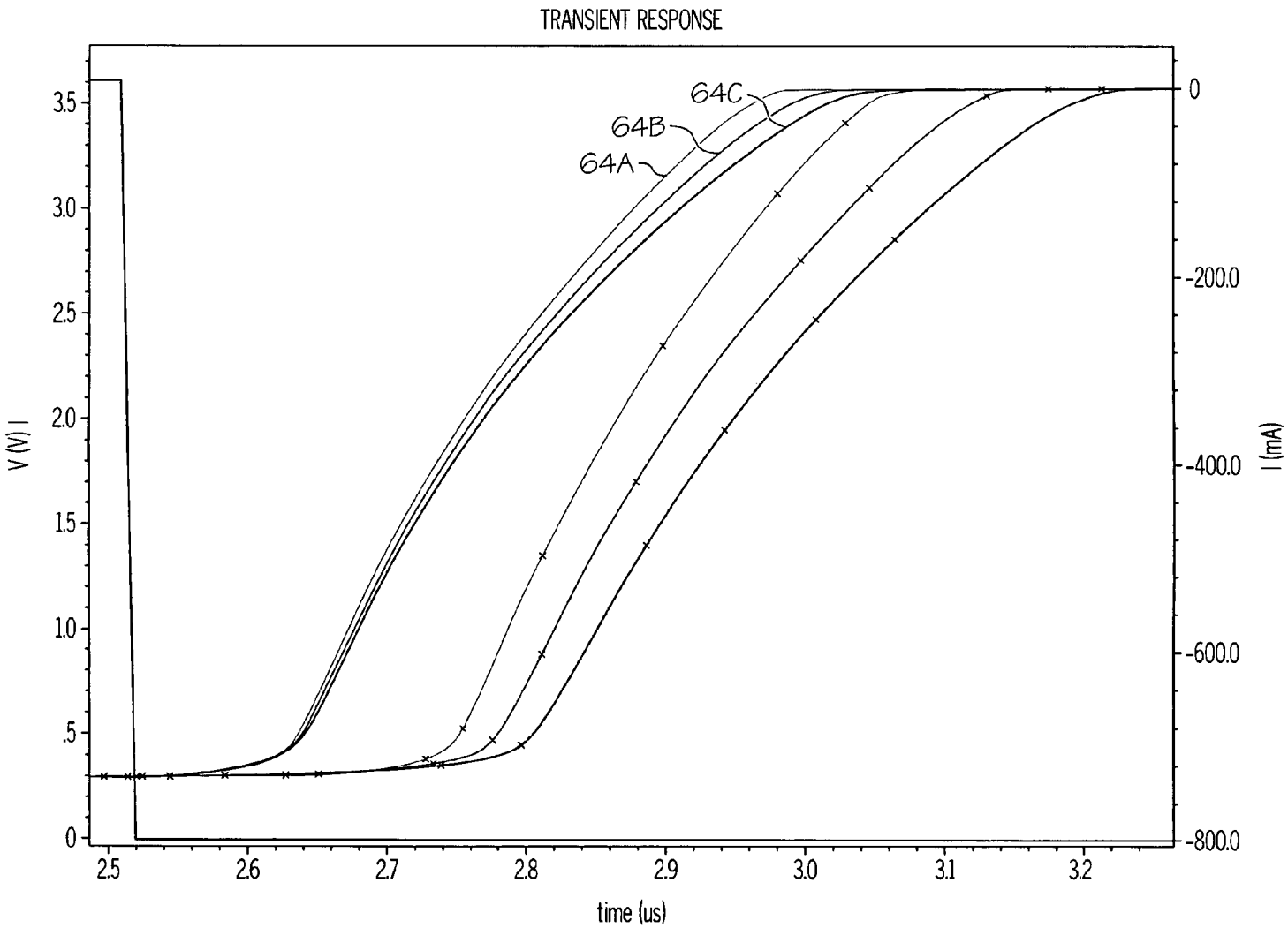
FIG. 5 is a graph indicating the consistent turn off times that the embodiment of FIG. 3 can obtain, in accordance with additional inventive principles.

The embodiment of FIG. 3 also exhibits consistent shutoff times with little variance even when subjected to greatly varying temperatures. FIG. 5 is a graph indicating examples of the consistent turn off times that the embodiment of FIG. 3 can obtain, even when the temperature of the circuit changes from 27 degrees Celsius to 50 degrees Celsius to 80 degrees Celsius, as shown by the graphs 64A, 64B, and 64C respectively. (These are typical operating temperatures of a printhead silicon chip at or near the location of where the pre-drive circuit would be located. The temperatures fluctuate greatly depending on how many nozzles are being fired and how many heaters are heated in a given period of time). The graph of FIG. 5 shows current that can be measured through one power line provided to the chip with all eight heaters supplied by that line being fired at once, as this represents the maximum current/back EMF that would be created by such a power line that supplies eight heaters. As shown in FIG. 5, the variance of the shutoff time graphs 64A-C based upon temperature is only about 60 nanoseconds over the typical operating range of 27 to 80 degrees Celsius. The shut off times of the current through the heater 84 in all three instances are less than about 550 nanoseconds and in some cases less than 500 nanoseconds. This amounts to less than about a 10 percent variance over the operating temperature range. In other embodiments, less than about 25 percent variance may be obtained. In addition, as shown by the graphs 64A-C, the shutoff time can change with respect to temperature by less than or equal to about 2 nanoseconds, and in particular less than or equal to about 1.2 nanoseconds, per degree Celsius over the range of temperatures.

Figure 6:
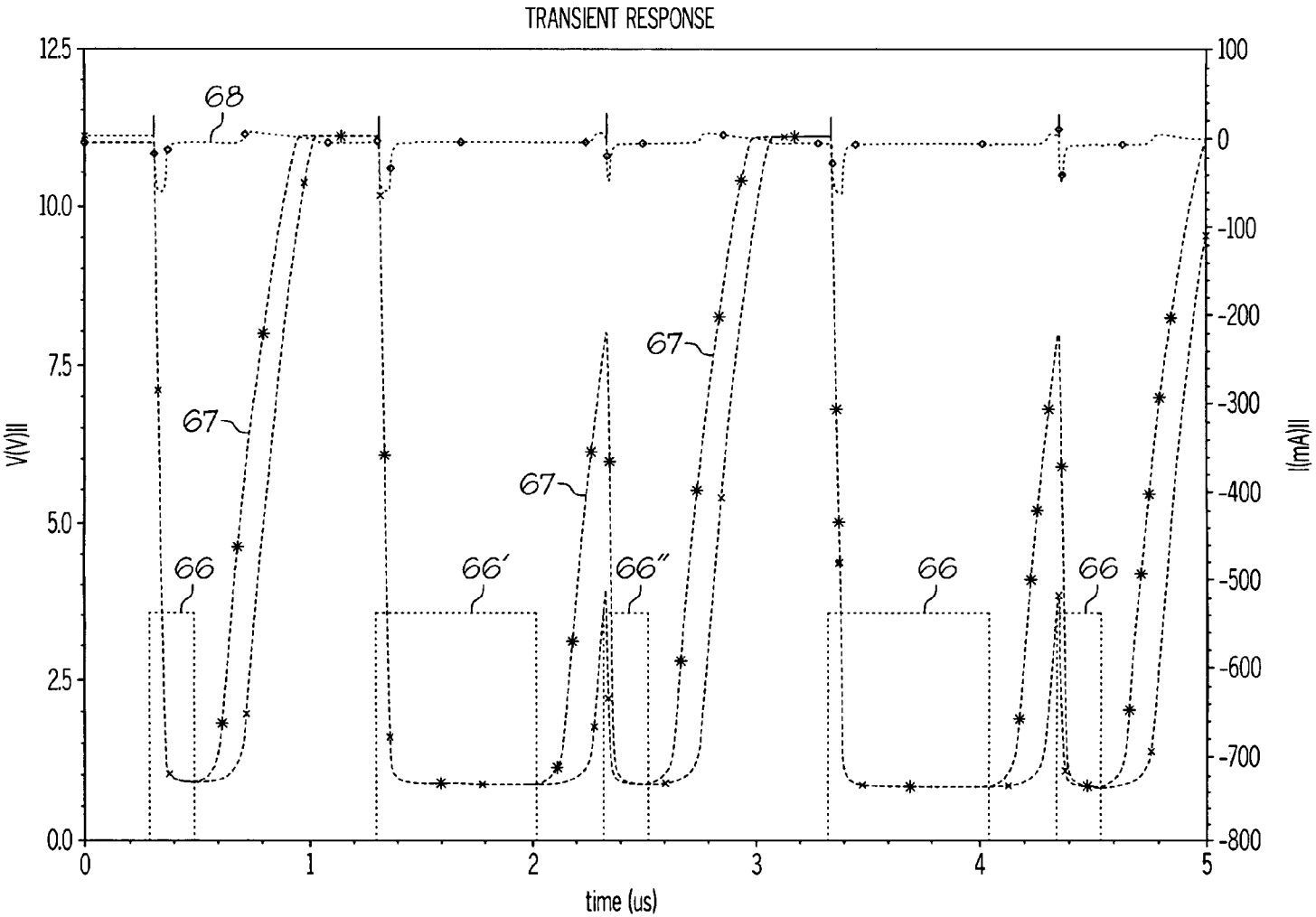
FIG. 6 is a graph illustrating the turn off time response that can be achieved by the example embodiment of FIG. 3 and in accordance with principles of the present invention.

FIG. 6 is a graph illustrating examples of the turn off time response that can be achieved by the example embodiment of FIG. 3. Graph 67 (shown with *'s) shows the current supplied to eight firing heaters through a power line in response to the firing signal provided on line 48, as shown by graph 66. The shutoff curves for individual heaters, such as heater 84 of FIG. 3 would be substantially the same with respect to time, but would differ in magnitude by about ⅛th. The heater current in this example can shut off in under about 500 nanoseconds as shown by graph 67. In other examples, the shut off can occur in under about 1000 nanoseconds, such as under about 600 nanoseconds, under about 500 nanoseconds, or under about 300 nanoseconds, for example. Even if there are short times between pulses (such as between pulses 66' and 66", where there is less than 250 nanoseconds between pulses), a substantial amount of shut off can be achieved (from over 700 milliamps to under 250 milliamps for eight heaters, or about ⅛th of these values for an individual heater). However, the shut off time is still large enough to achieve only a small back EMF as shown by graph 68. This induced voltage is not large enough to cause any appreciable damage or wear to the circuit components. (In this case, the voltage always remains below 12 volts which is well below the 14 volts or so that can cause damage with respect to some types of components).

Figure 7:
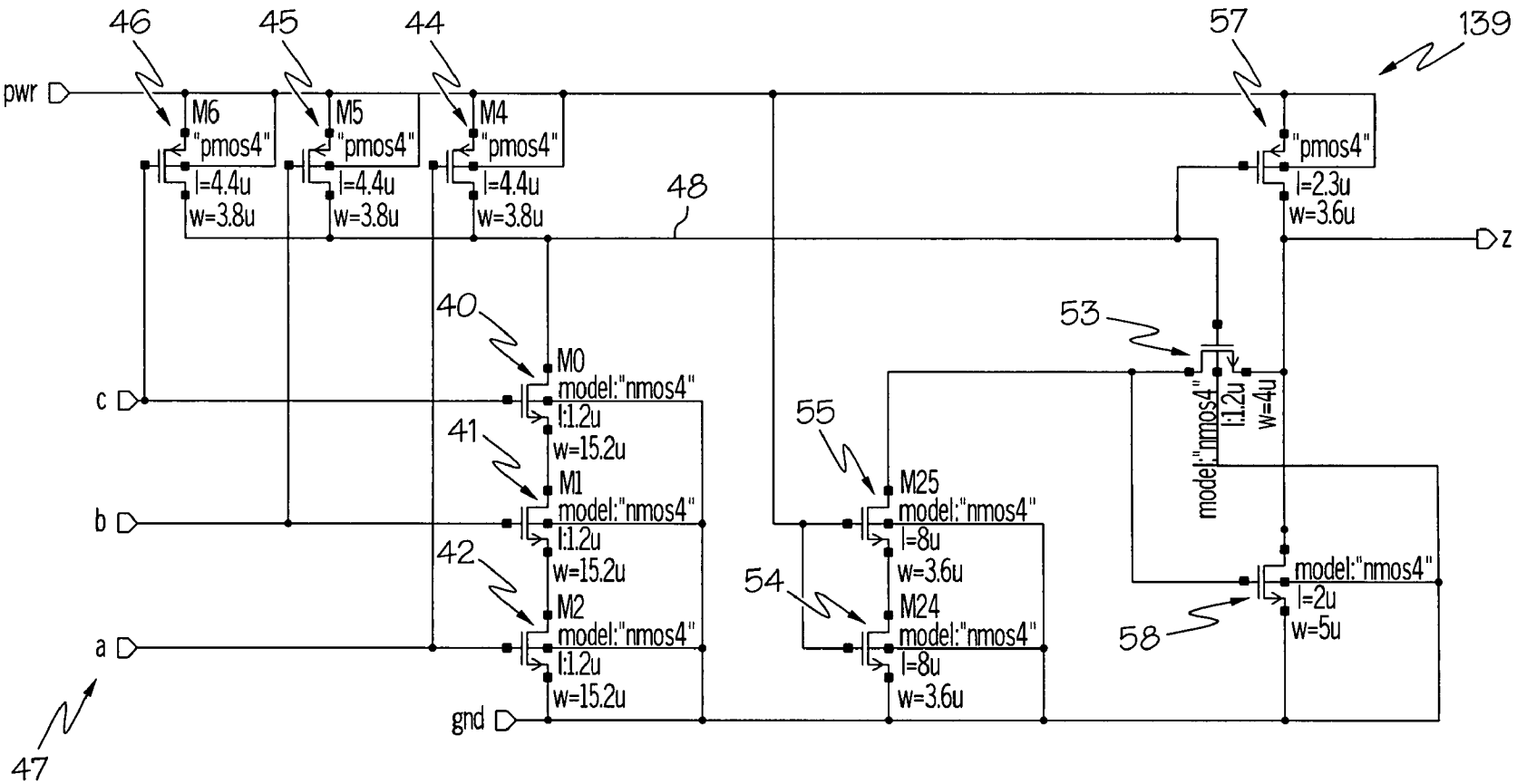
FIG. 7 is a circuit diagram illustrating another example embodiment of a pre-drive control circuit that controls the transitioning of a heater firing pulse, the circuit being made and operating according to principles of the present invention.

FIG. 7 is another illustrative embodiment of a pre-drive circuit 139 that can obtain controlled heater firing characteristics. The configuration in this example is similar to that of FIG. 3. However the resistor 50 in FIG. 3 is replaced with a pair of NMOS devices 55 and 54, which serve to provide the desired resistance. Thus, instead of connecting a resistor to ground, these devices are connected between the drain of the transistor 53 and ground, and the gates of these devices are connected to power such that they are always on. These devices are beneficial in that they take up less room in the circuit than does a traditional resistor, yet their inherent resistance provides the desired resistance. Additional such devices can be connected in series as desired to produce the desired resistance. The transistor 58 is again connected in this example to provide a diode effect. Thus, the controlled response similar to that of FIGS. 4-6 can be obtained, although some additional temperature variance may be introduced.

Figure 8:
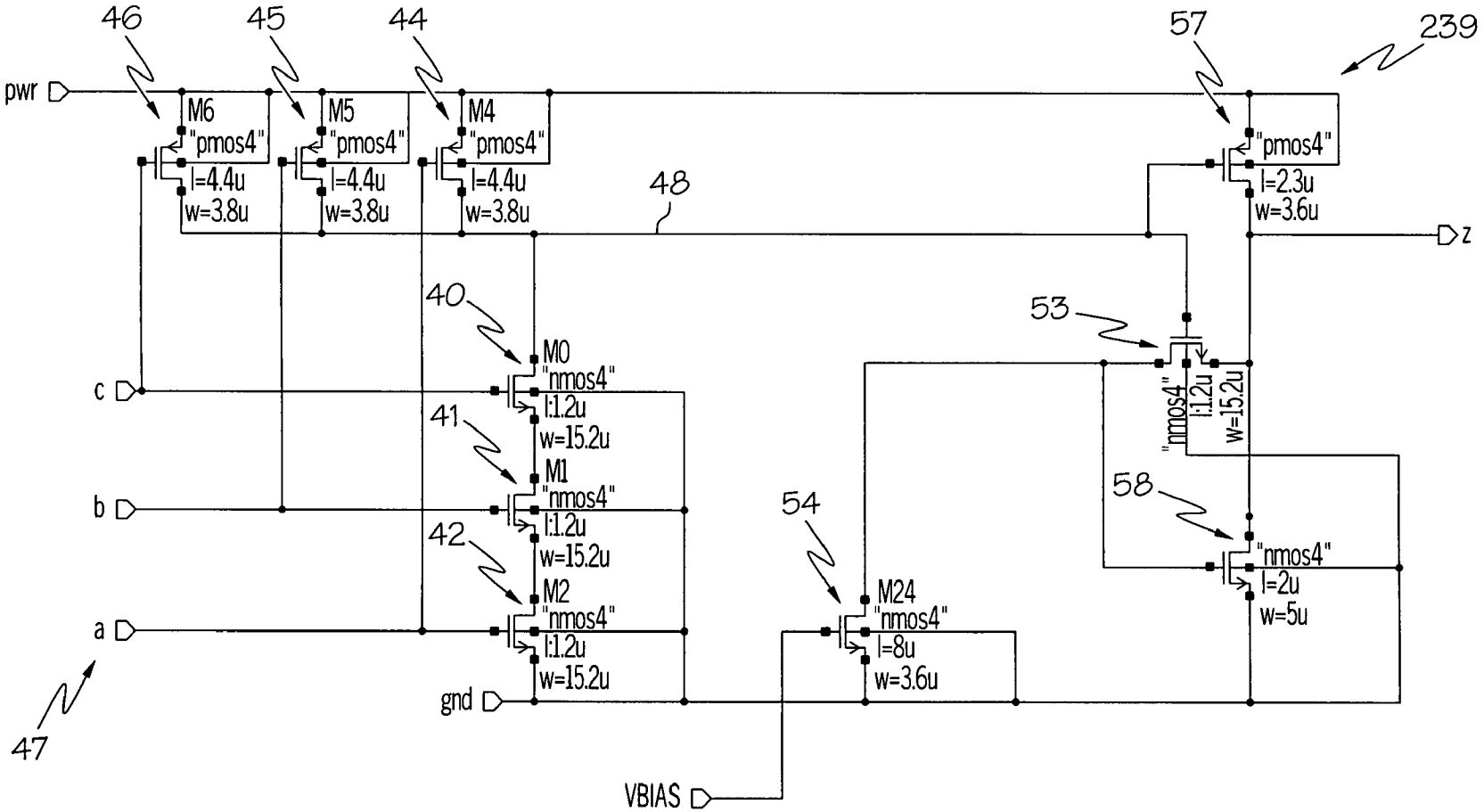
FIG. 8 is a circuit diagram illustrating an additional example embodiment of a pre-drive control circuit that controls the transitioning of a heater firing pulse, the circuit being made and operating according to principles of the present invention.

FIG. 8 is yet another illustrative embodiment of a pre-drive circuit 239 that can obtain controlled heater firing characteristics. In this example, the configuration is similar to that of FIG. 3, except that the resistor is replaced with a voltage controlled resistive component 54. In this example, instead of connecting a resistor between ground and the transistor 53, another NMOS transistor 54 is connected to the transistor 53 (drain to drain), with its source being connected to ground and its gate being connected to a controllable voltage source (VBIAS). Here, transistor 58 again acts as a diode, but transistor 54 acts as a voltage-controlled resistance having dynamic voltage control of resistance through the VBIAS pin. As shown, the required circuit area for implementing the resistance device 54 is relatively small, therefore providing manufacturing advantages. The voltage at the VBIAS pin controls the conduction of the device and the point at which it will switch on to allow the falling edge of the pulse at Z to dissipate to ground. The combination of this device 54 with the diode device 58 again allows for a combined dissipating effect. The voltage VBIAS can be varied as desired to allow for optimal effect. In some embodiments, a feedback mechanism can be provided to allow the voltage to be changed based upon changing conditions of the printhead (e.g., speed, temperature, etc.) to allow for an adjustable falling edge rate. In additional embodiments, multiple such devices 54 can be provided in parallel, and each device switched at varying points. For example, the devices could be switched at different times to allow for a sequential handling of the falling edge and to adjust the dissipating effect as needed or desired.

Figure 9:
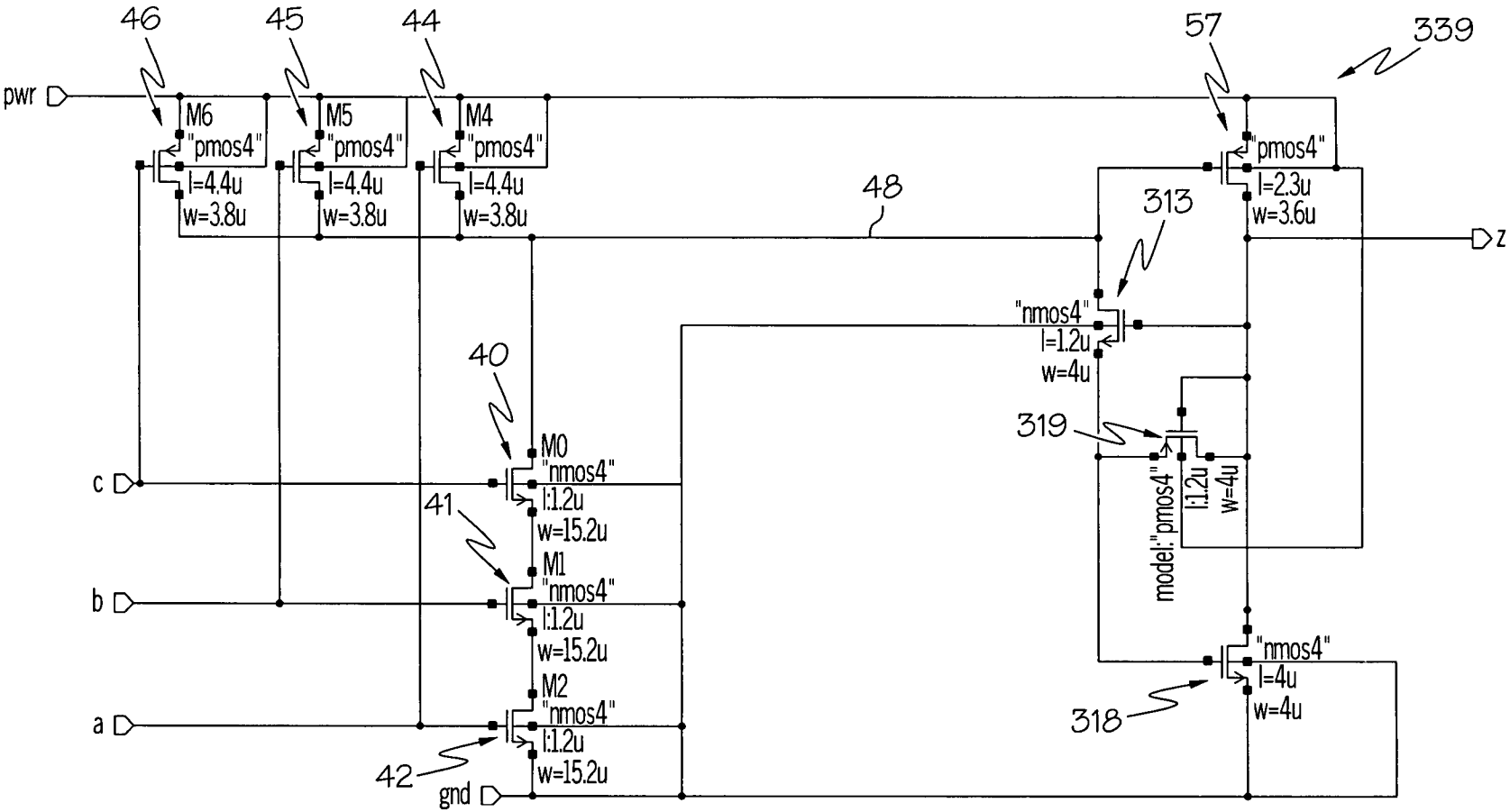
FIG. 9 is a circuit diagram illustrating another example embodiment of a pre-drive control circuit that controls the transitioning of a heater firing pulse, the circuit being made and operating according to principles of the present invention.

FIG. 9 is another illustrative embodiment of a pre-drive circuit 339 that can obtain controlled heater firing characteristics. In this example, the firing pulse and the resulting heater current are controlled by the nMOS transistors 313 and 318 and the pMOS transistor 319. In this embodiment, the output Z is connected to the gates of transistors 313 and 319 and to the drains of transistors 318 and 319. Also, the sources of transistors 319 and 313 are connected together and to the gate of transistor 318. (As with the other embodiments herein, PMOS transistors are also connected to power and NMOS transistors are connected to ground at their respective power and ground inputs). According to this embodiment, when the transmitted firing pulse on line 48 ends and the transistor 57 and driver 82 shut off, the transistor 313 turns on and allows transistor 318 to act as a diode and pull the current on line Z to ground. However, transistor 319 guarantees that the transistor 318 will remain on until all current is dissipated to ground. Accordingly, the combination of these components can provide a controlled dissipation over an optimal time length and can reduce effects of temperature on that time length such that it varies little over the operating temperature of interest (e.g., less than about 25% variance, such as less than about 20% variance or less than about 10% variance for example).

The foregoing description of various embodiments and principles of the inventions has been presented for the purposes of illustration and description. It is not intended to be exhausted or to limit the inventions to the precise form disclosed. Many alternatives, modifications and variations will be apparent to those skilled in the art. For example, some principles of the inventions may be used with different types of printers, printing devices, printheads, materials, and circuit elements. Moreover, although multiple inventive aspects and principles have been presented, these need not be utilized in combination, and various combinations of inventive aspects and principles are possible in light of the various embodiments provided above. Accordingly, the above description is intended to embrace all possible alternatives, modifications, aspects, combinations, principles, and variations that have been discussed or suggested herein, as well as all others that fall within the principles, spirit and broad scope of the inventions as defined by the claims.

What is claimed is:

1. A circuit for controlling magnitude of current flowing to an actuator element configured to deposit ink in a printing apparatus, the circuit comprising:

at least one switching device configured to selectively allow and cutoff the flow of current to an actuator based upon a firing signal turning on and off, wherein the actuator is configured to deposit a printing substance in a printing apparatus; and at least one circuit component having standard sizing relative to other components on the printing apparatus, wherein the component is configured to control the firing signal provided to the switching device in order to cause flow of current to the actuator to dissipate slowly enough such that damaging levels of voltages are not induced in the circuit, wherein the component is further configured to control the firing signal to cause flow of current to the actuator to dissipate quickly enough such that the actuator current reaches substantially zero in under about 1 microsecond.

2. The circuit as recited in claim 1, wherein the at least one circuit component comprises a component that dissipates current caused by the firing pulse according to a characteristic that approximates a diode.

3. The circuit as recited in claim 2, wherein the at least one of the plurality of components comprises an NMOS switching device.

4. The circuit as recited in claim 1, wherein the at least one circuit component is further configured to control the firing signal to cause flow of current to the heating element to dissipate quickly enough such that the heater current reaches substantially zero in under about 600 nanoseconds.

5. The circuit as recited in claim 1, wherein the circuit resides on a chip on a printhead, and wherein the printhead includes an ink chamber, nozzles configured to allows ink to exit the printhead, and connectors to receive address signals from a controller, and wherein the actuator comprises a heater element configured to heat the ink to cause it to exit the printhead.

* * * * *